United States Patent [19]

Cosco et al.

[11] 4,097,774

[45] Jun. 27, 1978

[54] ARC DISCHARGE FLASH LAMP AND SHIELDED COLD CATHODE THEREFOR

[75] Inventors: Robert J. Cosco, Amesbury; John M. Lo, Boston; Roger T. Hebert, Peabody, all of Mass.

[73] Assignee: GTE Sylvania Incorporated, Danvers, Mass.

[21] Appl. No.: 692,285

[22] Filed: Jun. 3, 1976

[51] Int. Cl.[2] ..... H01J 61/04

[52] U.S. Cl. ..... 313/178; 313/174; 313/207; 313/209; 313/217; 313/346 R; 313/353

[58] Field of Search ..... 313/207, 209, 217, 353, 313/174, 178, 213, 346 R

[56] References Cited

U.S. PATENT DOCUMENTS

| | | | |
|---|---|---|---|
| 2,716,713 | 8/1955 | Noel | 313/213 X |
| 2,899,588 | 8/1959 | Mueller et al. | 313/217 X |
| 2,926,277 | 2/1960 | White | 313/209 |
| 3,515,932 | 6/1970 | King | 313/207 X |
| 3,983,440 | 9/1976 | Scott et al. | 313/217 |

*Primary Examiner*—Rudolph V. Rolinec
*Assistant Examiner*—Darwin R. Hostetter
*Attorney, Agent, or Firm*—Grover and Meegan

[57] ABSTRACT

A cold cathode arc discharge flash lamp has a cathode assembly in which an electron emissive pellet is secured on the lead wire or rod entering the flash tube envelope. One or more coils of molybdenum or a similar body of ceramic refractory shield the emissive face of the pellet from destructive ion bombardment while exposing the face for electron emission.

5 Claims, 5 Drawing Figures

ARC DISCHARGE FLASH LAMP AND SHIELDED COLD CATHODE THEREFOR

RELATED APPLICATION

This invention constitutes an improvement on United States patent application Ser. No. 528,826 of Robert J. Cosco, Thomas A. Brewin and John A. Pappas, filed Dec. 2, 1974 for THREE-ELECTRODE SHORT DURATION FLASH TUBE, now abandoned, which is incorporated herein by reference.

BACKGROUND OF THE INVENTION

The present invention relates to cold cathode flash tubes which strike an intense arc at intervals as compared to thermionic lamps, of which an example is found in U.S. Pat. No. 3,753,028, continuously operating at relatively high temperatures. The cathodes of latter thermionic lamps typically operate at 2000° C and over, and use as an electron emissive source a thorium compound dependent on high ion current. On the other hand an intermittently operating flash lamp must strike an arc at a few hundred degrees cathode temperature at the most and its efficacy is rapidly degraded if the electron source is subjected to ion bombardment such as occurs in thermionic lamps.

Accordingly it is an object of the present invention to provide a cold cathode flash tube which supports electronic emission without degrading the electron emission by ion bombardment of the electron source.

STATEMENT OF THE INVENTION

According to the invention a cold cathode flash tube includes an elongate envelope enclosing at least one cathode assembly and an electron discharge and ion counterflow path respectively from and toward the assembly, wherein the cathode assembly comprises a lead wire extending into the envelope, a body containing electron emissive material, the body being supported by the lead wire, a mass of refractory material interposed in the ion counterflow path toward the body so as to shield a substantial emissive area of the body from ion bombardment, and means extending from the emissive body to the refractory mass for holding the mass in spaced relation to the body thereby to expose the shielded area for electron emission.

DRAWING

Figure 1:
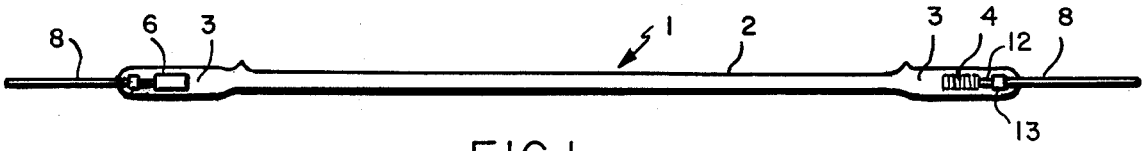
Figure 2:
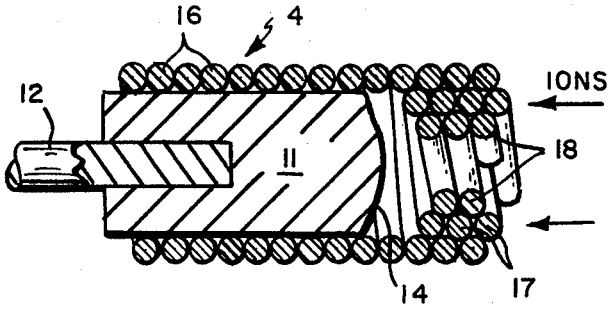
Figure 3:
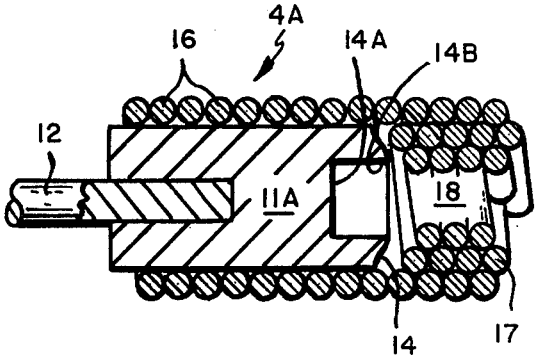
Figure 4:
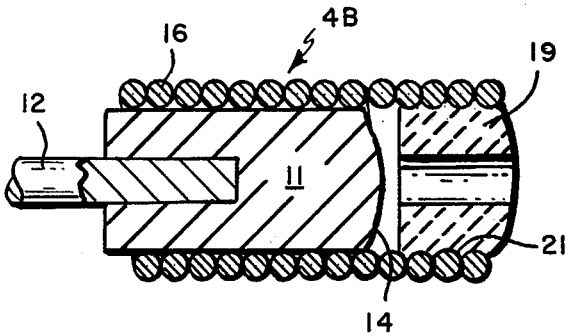
Figure 5:
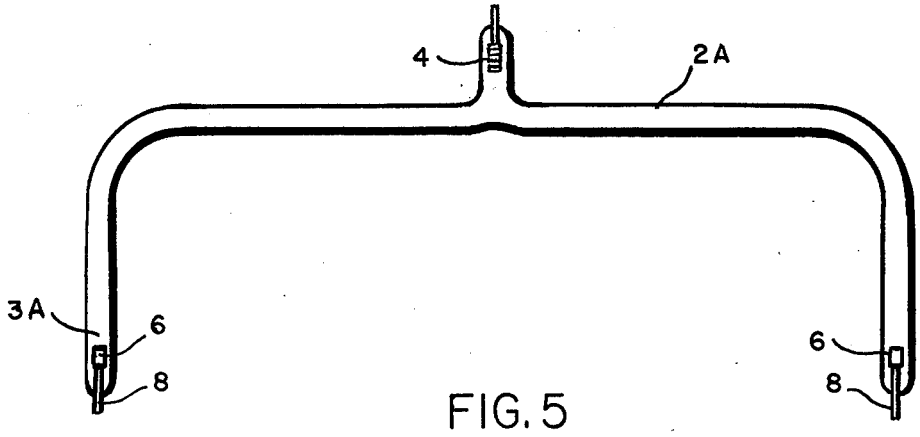

FIGS. 1 and 5 are views of flash tubes with cathode assemblies according to the invention; and FIGS. 2 to 4 are axial sections of three alternative forms of cathode assemblies.

DESCRIPTION

Flash tubes for various purposes may be straight as in FIG. 1 or folded as FIG. 5, both useful for illumination in photocopiers. Coiled and other forms of flash lamps are also useful.

The flash lamp 1 of FIG. 1 comprises a transparent envelope 2 of hard glass tubing with enlarged end chambers 3 respectively enclosing a cathode assembly 4 and an anode assembly 6. The envelope 2 is filled with a rare gas such as xenon at subatmospheric pressure, e.g. 600 Torr. As an example, the tube may have ¼ inch O.D. and 12 inches length between anode and cathode. The anode assembly 6 may comprise a hollow roll of one, two or more turns of tantalum foil welded to a 0.06 inch tungsten or molybdenum lead-in wire or rod 8. The cathode assembly, described later in detail, includes a coil of refractory wire over an electron emissive pellet (not visible in FIG. 1) supported on a lead wire or rod 12. The lead wire may run continuously from outside the envelope, or may include a coupling 13 of refractory metal foil or tubing. In operation several thousand, e.g. 3500 to 4500, volts are applied across the cathode and anode and a trigger pulse of much higher voltage is applied internally or externally of the envelope to ignite an arc between cathode and anode. The arc consists of an electron flow emitted on a path extending from the cathode pellet toward the anode, and an ion counter flow from anode to cathode.

In the flash tube of FIG. 5 the cathode assembly is in a chamber at the center of a U-shaped folded envelope 2A with two end chambers surrounding anode assemblies 6. A pair of such flash lamps is particularly useful to form a rectangular light source around the illuminated area of a photocopier or other photographic equipment.

The form of cathode assembly 4 in FIG. 2 includes an electron emissive, cold cathode pellet 11 pressed and sintered on the previously described lead wire 12. A suitable pellet composition is 89.5% tantalum forming a getter material matrix for 10%, electron emissive, barium aluminate and 0.5% nickel to which is added the equivalent of 2% wax binder. The right hand curved end 14 of the pellet in FIGS. 2 and 4 comprises the electron emissive surface, whereas in FIG. 3 the emissive surface includes the bottom 14A and side wall 14B of a hollow in the face 14.

Around the pellet of either form is an overwind 16 of tungsten or other refractory metal wire extending over a substantial portion of the pellet 11 and beyond the emitting surface 14, 14A or 14B. For a pellet approximately 0.375 inch long and 0.165 inch in diameter an overwind wire size of 0.030 to 0.040 inch diameter is suitable. Although the flash tube is a cold field emission device some diffusion heating is necessary to replenish emissives at the surface 11, which heating may be reduced by heat sink effect of the overwind. As one example the pellet size was reduced to approximately 0.100 inches and the coil wire diameter to 0.015 to 0.020 inches to provide adequate diffusion heating in a flash tube having an average power rating of 23 watts and an operational rating of 40 watt-seconds at 500 volts. Preferably the overwind 16 is wound at 100% pitch, i.e. adjacent turns touching, but diffusion heating may be controlled by looser winding.

According to the present invention the pellet is supported solely by the lead wire 12 so that the overwind 16 may support a further mass of refractory material spaced from the pellet or at least not in intimate contact with the pellet. For example, in FIGS. 2 and 3 the refractory mass comprises two short inner tungsten wire coils 17 and 18 of progressively smaller diameter threaded inside the overwind 16 and then spot welded in a position spaced from the emissive face 14 of the pellet 11. The inner coils 17 and 18 are preferably of the same diameter wire and pitch as the overwind 16. In FIG. 4 the refractory mass is a compacted tube 19 of sintered tungsten or alumina having threads 21 formed on its periphery which mate the thread of the overwind 16. One or more of the inner coils 18 and 17 or the threaded tube 19 shield the emissive face 14 of the pellet 11 or 11A by interposition in the ion stream toward the pellet.

It should be understood that the present disclosure is for the purpose of illustration only and that this invention includes all modifications and equivalents which fall within the scope of the appended claims.

We claim:

1. A cold cathode flash tube including an elongate envelope enclosing at least one cathode assembly and an electron discharge and ion counterflow path respectively from and toward the assembly, wherein the cathode assembly comprises:

a lead wire extending into the envelope, a discrete body containing a sintered compound of electron emissive material, the body being intermittently emissive when cold and being disposed on the lead wire;

a mass of refractory metal material interposed in the ion counterflow path toward the body so as to shield a substantial emissive area of the body from ion bombardment; and means extending from the emissive body to the refractory metal mass for holding the mass in spaced relation to the body thereby to expose the shielded area for electron emission.

2. A cathode assembly according to claim 1 wherein the emissive body comprises a single unit consisting of emissive material and getter material.

3. A cathode assembly according to claim 1 wherein the emissive body comprises a barium compound.

4. A cathode assembly according to claim 2 wherein the emissive body comprises a barium compound.

5. A cathode assembly according to claim 2 wherein the emissive body comprises a matrix of tantalum getter.

* * * * *